US005244199A

United States Patent [19]

Wood

[11] Patent Number: 5,244,199

[45] Date of Patent: Sep. 14, 1993

[54] STREAM FEEDING MACHINE FOR HOLDING AND DELIVERING SIGNATURES

[75] Inventor: James R. Wood, Salem, Ill.

[73] Assignee: St. Denis Manufacturing Co., Effingham, Ill.

[21] Appl. No.: 918,078

[22] Filed: Jul. 24, 1992

[51] Int. Cl.[5] ..... B65H 1/02

[52] U.S. Cl. ..... 271/150; 271/31.1; 271/161

[58] Field of Search ..... 271/150, 161, 31.1

[56] References Cited

U.S. PATENT DOCUMENTS

| | | | |
|---|---|---|---|
| 4,531,343 | 7/1985 | Wood . | |
| 4,588,180 | 5/1986 | Ballestrazzi | 271/150 X |
| 4,641,489 | 2/1987 | Wood . | |
| 4,771,896 | 9/1988 | Newsome . | |
| 4,809,964 | 3/1989 | Wood . | |
| 4,824,093 | 4/1989 | Belden . | |
| 4,934,682 | 6/1990 | Rece | 271/150 X |
| 4,973,038 | 11/1990 | Curley | 271/150 X |
| 5,161,792 | 11/1992 | Wood | 271/31.1 X |

OTHER PUBLICATIONS

Muller Martini Corp., *The Bundling and Bundle Loading System "BSF", 1982.*

Muller-Martini Corp., *Muller-Martini Bundler and Bundle Loading System, Description,* title page and pp. 13-19.

McCain Manufacturing Corp., *McCain 1800.*

*The Sheridan Model FG Pacesetter Inserter* (one page).

*Primary Examiner*—Richard A. Schacher

*Attorney, Agent, or Firm*—Polster, Lieder, Woodruff & Lucchesi

[57] ABSTRACT

A machine, for holding signatures and delivering them to a pocket in an inserter unit that forms part of a binding machine, has three conveyors, namely a feed conveyor, a spreading conveyor, and a pocket conveyor arranged in that order between a loading position and the pocket of the inserter unit. All three of the conveyors have table belts and side belts with the spacing between the side belts being less than the width of the signatures, so that the signatures bow forwardly when standing on edge in the conveyors. The belts of the spreading and pocket conveyors advance the signatures more rapidly then the belts of the feed conveyor, so that the signatures are less consolidated on the spreading and pocket conveyors. The table belts of the pocket conveyor are inclined downwardly away from the table belts of the spreading conveyor, but a supporting surface exists at the center of the pocket conveyor as an extension of the table belts in the spreading conveyor. This surface suports the bowed center portions of the signatures as they emerge from the spreading conveyor, at least until the side edges of those signatures pass free of the side belts for the spreading conveyor, thus enabling the initial signatures to transfer between the two conveyors without toppling forwardly through the pocket conveyor. The drive motors for the two sets of side belts and the set of table belts of the pocket conveyor are controlled independently of each other so that the signatures emerging from the pocket conveyor will assume an orientation most suitable for extraction by an extracting mechanism in the inserter.

24 Claims, 5 Drawing Sheets

FIG. 8.
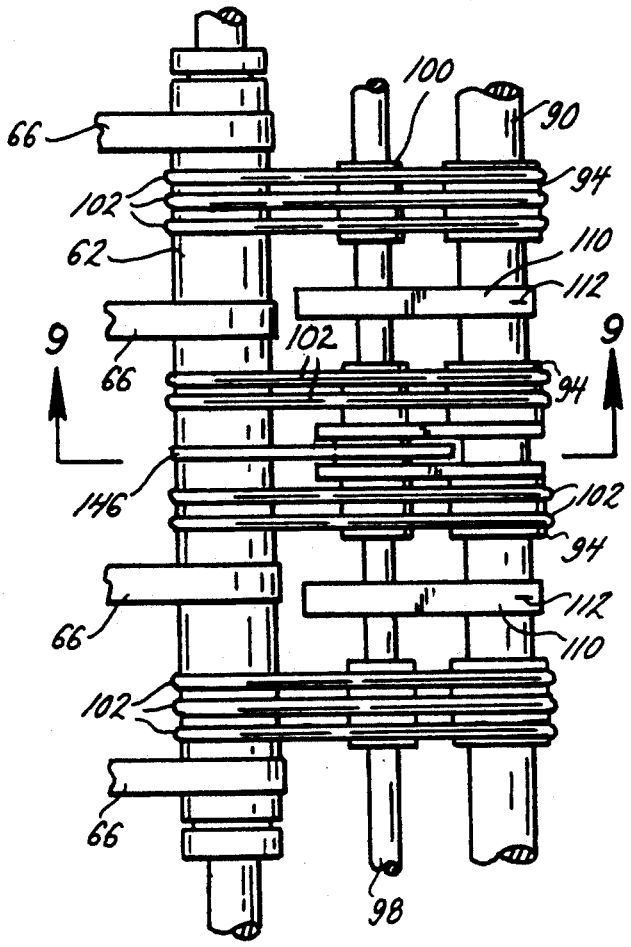
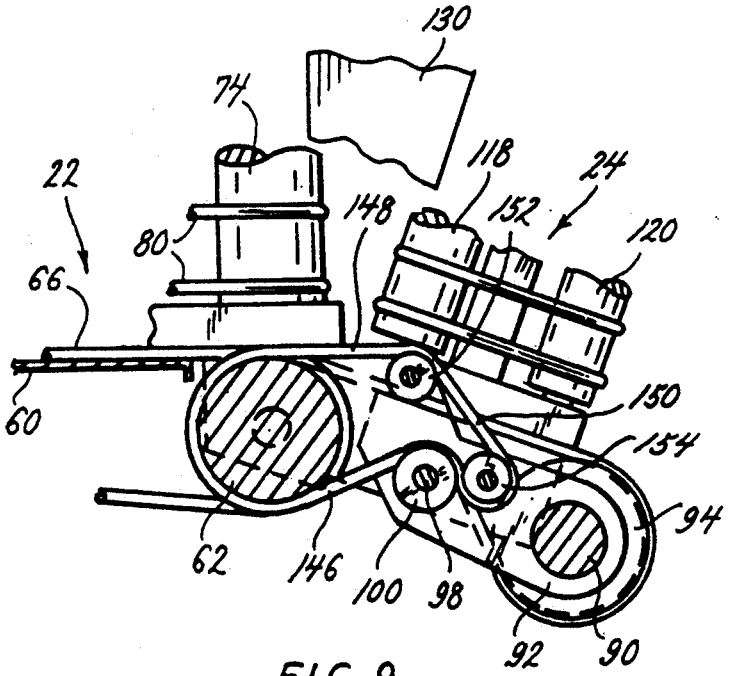
FIG. 9.

STREAM FEEDING MACHINE FOR HOLDING AND DELIVERING SIGNATURES

BACKGROUND OF THE INVENTION

This invention relates in general to machines for holding and delivering flexible sheets, such as signatures, and more particularly to a stream feeding machine for delivering signatures to a binding machine.

Printing magazines and similar publications involves a considerable amount of material handling. Large offset presses produce the printed material as folded signatures which are arranged in stacks by the machine. Workmen remove the stacks from the presses and deposit them on pallets on which they are stored as so-called hand lifts or the workmen may bind several short stacks of the signatures together with bands to form longer bundles or logs. Since the bands maintain the signatures under compression, the bundles or logs conserve storage space. In any event by storing the signatures, one or two presses may produce all the signatures that are required for a magazine.

Once all the signatures required for a magazine are available, they are assembled in the proper order to produce multiple copies of the magazine. Where a magazine contains relatively few pages or even a moderate number of pages, it will normally be assembled with a saddle binding, that is with the signatures in effect nested with their folds lying along essentially a common line. Staples are driven through the overlying folds at several locations to hold the signatures together as a magazine. Saddle binding machines exist for this purpose.

The typical saddle binding machine has inserter units arranged one after the other, with each unit having a pocket that holds no more than about one hand lift of signatures, which equates to a stack measuring about 8 to 14 inches high. Of course, the signatures differ from unit to unit, but within the pocket of any unit all of the signatures are the same. Behind the pocket of each unit lies a mechanism for extracting the signatures one at a time from the pocket and thereafter opening the signatures each with its fold presented upwardly. Indeed, the mechanism after opening a signature releases the signature and allows it to drop onto a chain which moves past the extracting mechanisms for all the inserter units. Thus, the signatures accumulate one over the other with their folds directly over the chain somewhat like a saddle. The pockets of the inserter units hold the signatures in an edge standing condition, but at about a 20° degree angle to the vertical. A chain drive at the bottom of each pocket advances the signatures to an inclined back plate at the end of the pocket, and here the extracting mechanism withdraws the signatures, one after the other.

By reason of their relatively small capacity, the pockets of the inserter units in a saddle binding machine require frequent replenishment. Indeed, a single worker can only monitor and replenish about three pockets, so the typical saddle binding machine requires quite a few workers simply to fill the pockets of the machine as it operates. Moreover, the hand and arm motions required for placing hand lifts of signatures in an edge-standing condition in the pockets contribute to the physical disability known as carpal tunnel syndrome, which is very painful.

So-called stream feeders exist for automatically feeding signatures to the inclined pockets of saddle binding machines, but these machines move the signatures through a tortuous path where they go from edge-standing condition to a shingled condition, from which they are dropped one after the other into the pockets of the inserter units. These machines are quite complex and expensive.

The present invention resides in a stream feeder which holds signatures in an edge-standing condition as an array and moves those signatures generally horizontally and then at an angle, all while maintaining complete control over the signatures. It will feed the inclined pocket of an inserter unit automatically. Multiple stream feeders enable a single workman to attend to considerably more pockets so the binding machine can be operated with fewer attendants. The stream feeder to a large measure avoids the motions which contribute to carpal tunnel syndrome. It occupies little floor space and is generally inexpensive to operate.

DESCRIPTION OF THE DRAWINGS

In the accompanying drawings which form part of the specification and wherein like numerals and letters refer to like parts wherever they occur:

FIG. 8 is a fragmentary plan view of the bottom of the pocket conveyor, with the pocket conveyor having a modified support means for preventing the signatures from toppling out of the spreading conveyor; and FIG. 9 is a sectional view taken along line 9—9 of FIG. 8.

DETAILED DESCRIPTION

Figures 1, 2:
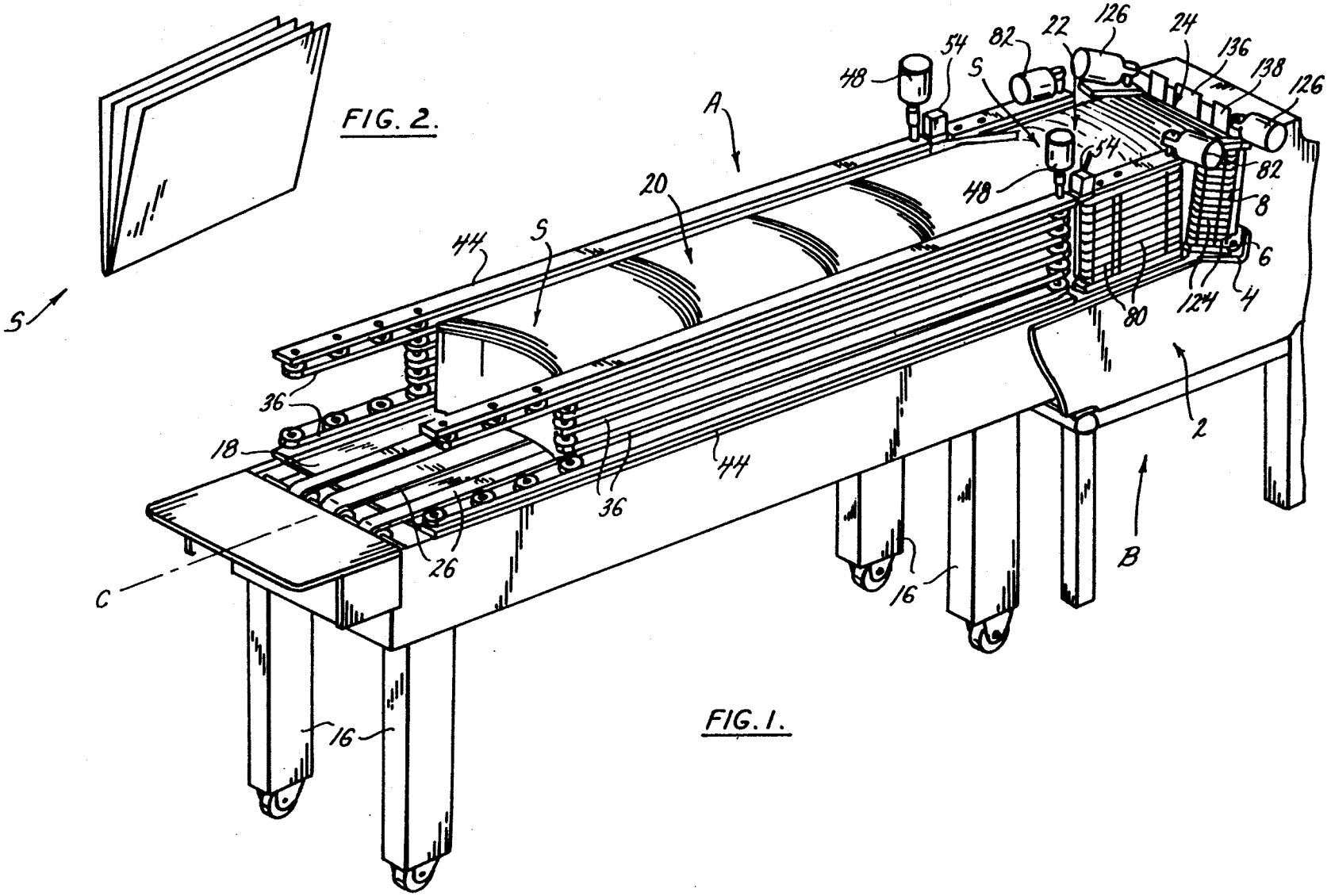
FIG. 1 is a perspective view of a stream feeding machine constructed in accordance with and embodying the present invention, the machine being shown loaded with signatures and coupled with an inserter unit of a saddle binding machine.
FIG. 2 is a perspective view of a signature of a type handled by the stream feeding machine.

Referring now to the drawings, a stream feeding machine A (FIG. 1) delivers signatures S (FIG. 2) to a binding machine B which assembles the signatures S along with signatures supplied by other stream feeding machines into a magazine, booklet or some other type of publication. The signatures S are hand-loaded into the stream feeding machine A, which has the capacity to hold a large supply of signatures—many more than the binding machine itself—and advances the signatures S into the binding machine B so that the binding machine B has a constant and steady supply of signatures S. Yet the machine A maintains precise control over the edge-standing signatures S.

The binding machine B is conventional, it having a separate inserter unit 2 (FIGS. 1 & 6) for each type of signature S that is assembled by the machine into a magazine or booklet. The unit 2 contains a pocket 4 where it receives the signatures S and also a mechanism 6 for extracting signatures S from the pocket 4, for opening the signatures S and then for depositing the opened signatures S on a chain which moves past the unit 2. The pocket 4 is inclined somewhat, it having a back wall 8 which is oriented at about 20° with respect to the vertical. Normally a feed table exists at the bottom of the pocket 4, it being oriented at about 20° with respect to the horizontal—and this table has chains on which the signatures rest. Indeed, the chains of a feed table move the signatures in an edge-standing condition to the back wall 8. The extracting mechanism 6 grips only one signature at a time, and withdraws it from the pocket 4, that being the signature S which is against the back wall 8 of the pocket 4. But the feed table of a conventional inserter holds only a very small quantity of signatures. To accommodate the stream feeding machine A, the feed table and its chains are removed so the end of the feeding machine A may be fitted to the pocket 4. Indeed, the stream feeding machine A forms the floor of the pocket 4.

The stream feeding machine A includes a frame 14 (FIGS. 1, 3 & 4) having adjustable legs 16 and a table 18 supported on the legs 16, its elevation being established by the legs 16. The table 18 has a feed end and a discharge end and between the two ends is generally planar and horizontal. The legs 16 are offset enough from the discharge end of the table 18 to enable the discharge end to fit over the inserter unit 2 of the binding machine B, and indeed the frame 14 at the discharge end of the table 18 is configured to fit into the pocket 4 of the inserter unit 2. The frame 14 supports three conveyors along its table 18, namely a feed conveyor 20, a control or spreading conveyor 22 and a final or pocket conveyor 24 arranged in that order between the feed end of the table 18 and the back wall 8 of the pocket 4 for the binding machine B. The three conveyors 20, 22, 24 have a common centerline C.

Figures 3, 4:
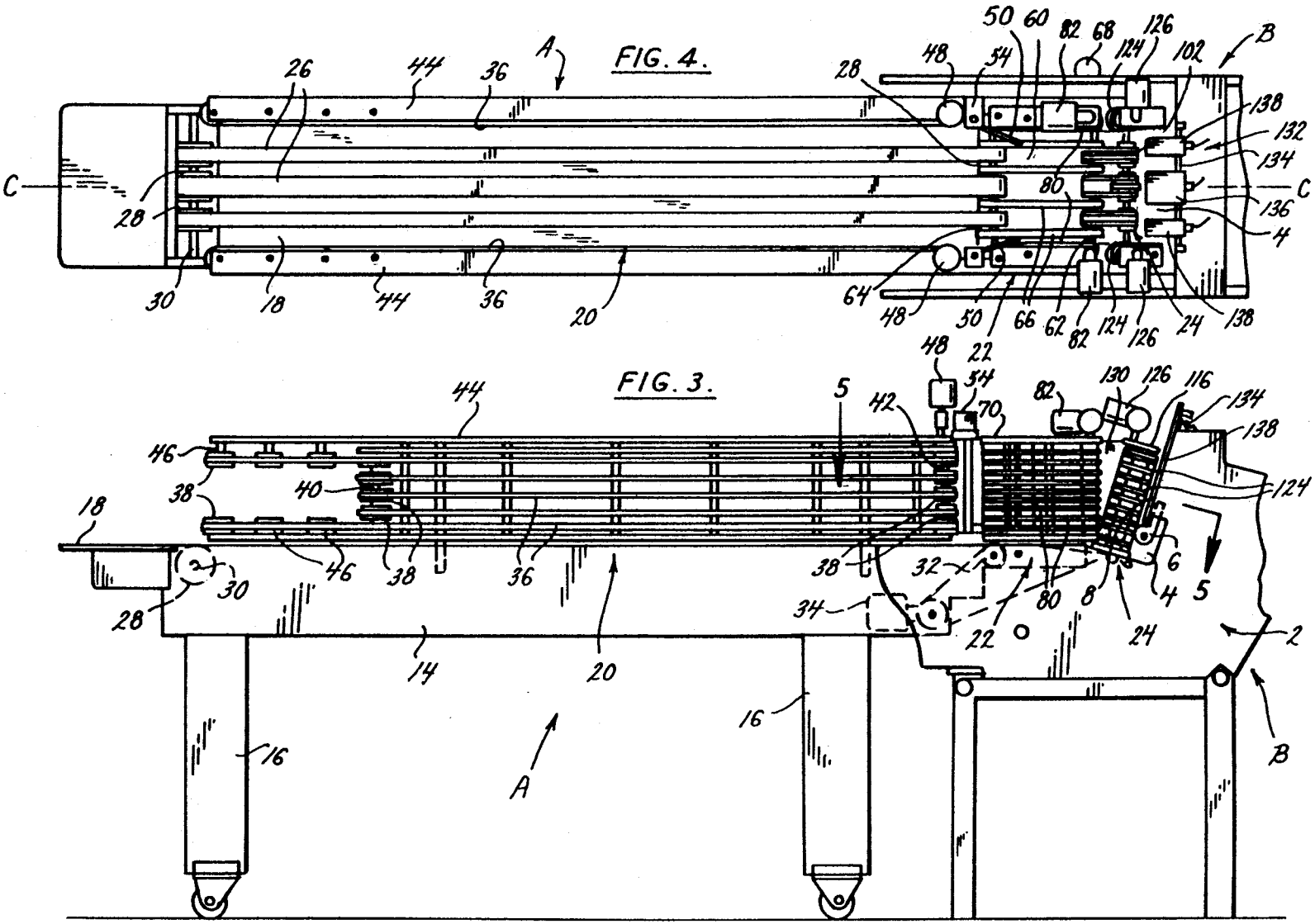
FIG. 3 is a side elevational view of the stream feeding machine coupled with the inserter unit of the binding machine.
FIG. 4 is a plan view of the stream feeding machine.
Figure 6:
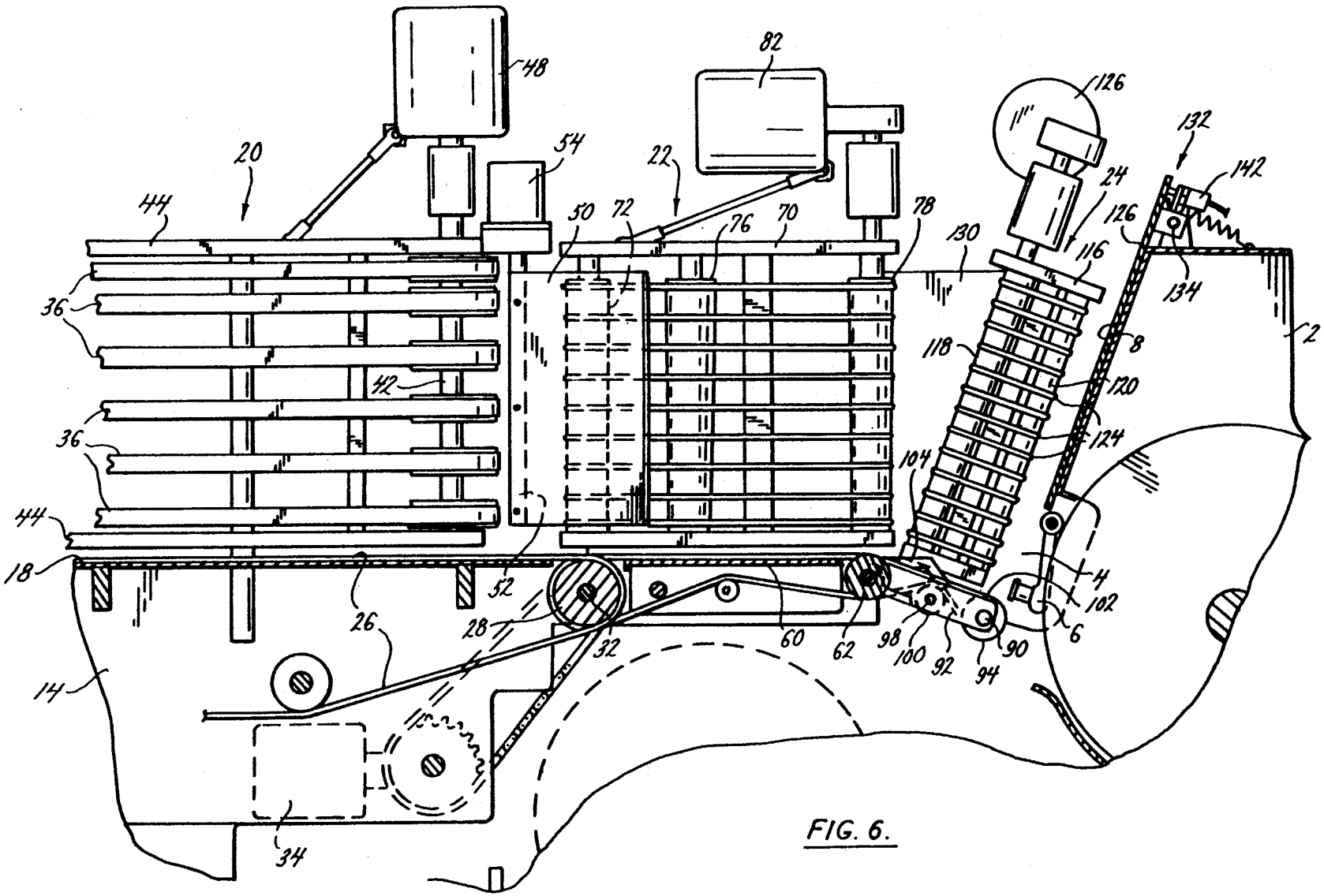
FIG. 6 is a sectional view taken along line 6—6 of FIG. 5.

The feed conveyor 20 occupies most of the table 18. It includes table belts 26 (FIGS. 3 & 4) which pass around pulleys 28 located on cross shafts 30 and 32 at the feed and discharge ends of the conveyor 20, respectively. The shafts 30 and 32 rotate in bearings that are attached to the frame 14 and the downstream shaft 32 is coupled to a synchronous gear motor 34 (FIGS. 3 & 6). The upper passes of the table belts 26 rest on and move over the table 18, and the motor 34 turns the shaft 32 such that the upper passes of the belts 26 move downstream, that is toward the control conveyor 22.

Actually the feed conveyor 20 is U- or trough-shaped, its sides being formed by side belts 36 (FIGS. 3 & 4) which pass over pulleys 38 that are mounted on vertical shafts 40 and 42, which are in turn mounted on side frames 44 that rise upwardly from the table 18. The shafts 42 while being located at the downstream end of the conveyor 20, are nevertheless offset slightly from the shaft 32 for the table belts 26 so that the table belts 20 extend further downstream beyond the side belts 36. At the upstream end of the feed conveyor 20, the uppermost and lowermost side belts 36 on each side frame 44 extend beyond the upstream shaft 40 for the side frame 44 and pass over more pulleys 38 which rotate on stub shafts 46, the spacing between the two extended belts 36 being large enough to accommodate a workman's hand. Each vertical shaft 42 at the downstream end of the feed conveyor 20 is coupled to a synchronous motor 48 (FIG. 6) which drives the shaft 42 such that the inner passes of the side belts 36 move downstream toward the spreading conveyor 22. The motors 34 and 48 drive their respective belts 26 and 36 at the same velocity. The spacing between the inner passes of the side belts 36 is slightly less than the width of the signatures S so that when a signature S is placed in the feed conveyor 20 with its bottom margin resting on the table belts 26 and its side margins against the side belts 36, it will assume a slightly bowed configuration (FIG. 1).

To load the feed conveyor 20 a workman takes a hand lift or short stack of signatures S, turns it such that the folds of the signatures are presented downwardly, and then forces it between the side belts along each side of the conveyor 20 with the signatures S of the stack bowed forwardly toward the spreading conveyor 22. The voids between the extended side belts 36 on each side of the conveyor 20 at its feed or upstream end enable the workman to maintain a grip on the short stack as it enters the feed end of the conveyor 20. The side margins of the signatures S bear against the inner passes of the side belts 36, while the bottom margins, which are the folds, contact the upper passes of the table belts 26. Hence, the signatures S will move with the belts 26 and 36 toward the spreading conveyor 22. Since the signatures S are bowed within the feed conveyor 20, each remains upright and does not exhibit any tendency to topple, even in the absence of an adjacent signature S to provide support.

The two side frames 44 are adjustable inwardly and outwardly on the table 18 to accommodate signatures S of different width.

Immediately beyond the pulleys 38 on the shafts 42 at the downstream end of the feed conveyor 20 lie control gates 50 (FIG. 5) which project into the spreading conveyor 22. The gates 50 are attached to shafts 52 which rotate when the gates 50 swing toward and away from the common centerline C of the two conveyors 20 and 22. The shafts 52 extend from potentiometers 54 which are mounted on brackets that are affixed to the side frames 44. In a sense, the signatures S at the downstream end of the feed conveyor 20 extrude through the gates 50 into the spreading conveyor 22 (FIG. 1). If the signatures S are somewhat compacted in the spreading conveyor 22, the gates 50 will assume a more open condition, that is they will lie along the sides of the spreading conveyor 22. But if they are somewhat loose in the conveyor 22 the gates 50 will swing inwardly toward each other under the bias of their springs. In other words, the position of the gates 50 is a measure of the back pressure produced by the signatures S in the spreading conveyor 22, and that in turn is a reflection of the speed at which the feed conveyor 20 introduces the signatures S into the spreading conveyor 22. When the amount of consolidation is optimum, the gates 50 will assume a known angle and the potentiometer 54 will produce a signal reflecting that angle. Through suitable circuitry that signal controls the motors 34 and 48 of the feed conveyor 20, turning the motors 34 and 48 on and off to maintain the gates 50 at the proper angle. This assures the correct back pressure and consolidation in the array of signatures within the spreading conveyor 22. Actually the signal by which the motors 34 and 48 are controlled represents an average of the signals from the potentiometers 54 for the two gates 50 so the two gates 50 need not, and often do not, assume the same angle.

Figure 5:
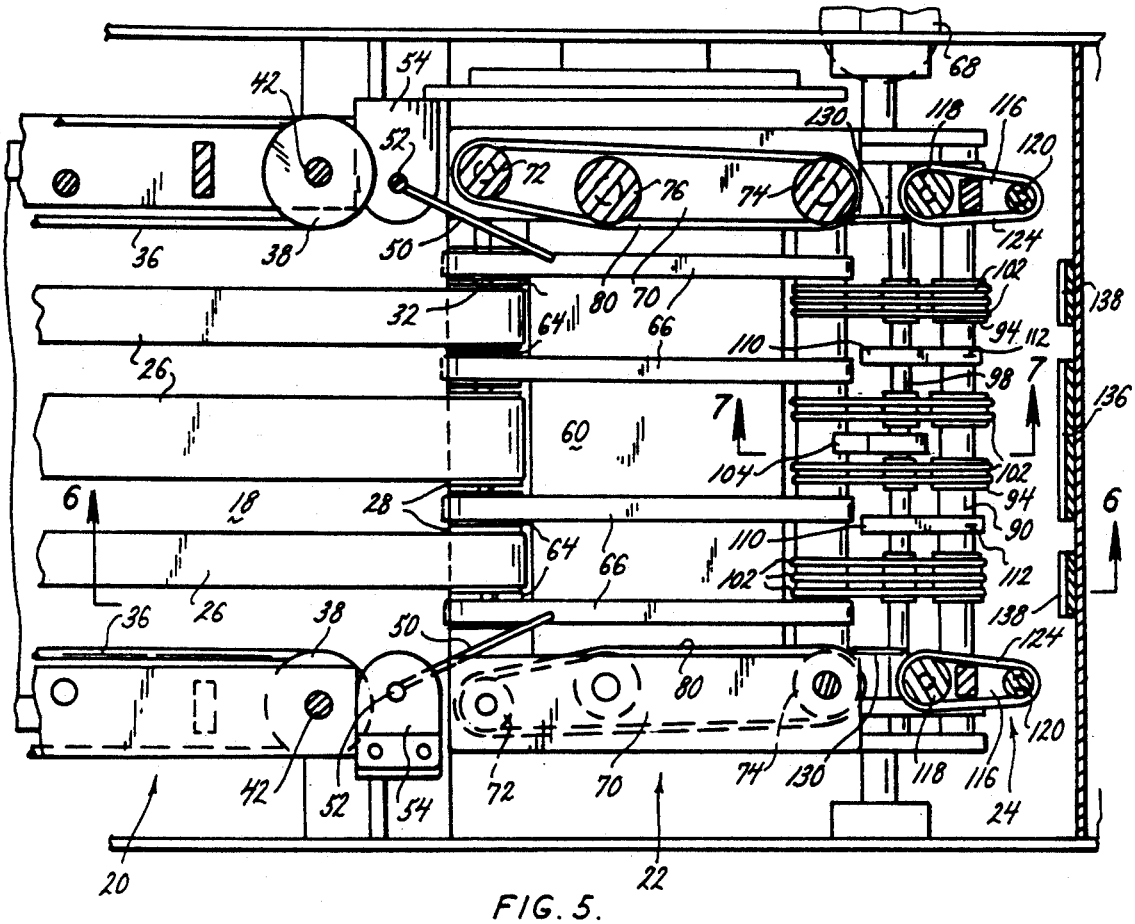
FIG. 5 is a sectional view taken along line 5—5 of FIG. 3.

The spreading conveyor 22 lies over the inserter unit 2 of the binding machine B where it leads up to the pocket conveyor 24 in the pocket 4 of the unit 2 (FIGS. 5 & 6). It receives the stream of edge-standing signatures S from the feed conveyor 20 and separates those signatures S so that they are not so tightly packed, thus enabling the signatures S to be extracted more easily on an individual basis. The spreading conveyor 22 includes a base plate 60 which is mounted on the frame 14 beyond the downstream cross shaft 32 of the feed conveyor 20 and cross shaft 62 located beyond the upstream end of the plate 60. Actually, the two conveyors 20 and 22 share the cross shaft 32, that shaft having pulleys 64 which are part of the spreading conveyor 22 as well as the pulleys 28 which are part of the feed conveyor 20. Whereas the pulleys 28 are fixed to and driven by the shaft 32, the pulleys 64 will rotate on the shaft 32 or, in other words, are free wheeling. Extended over the pulleys 64 on the cross shaft 32 as well as around the cross shaft 62 at circumferential grooves in that shaft are table belts 66, the upper passes of which pass directly over the base plate 60, while the lower passes lie beneath it. The cross shaft 62 is coupled to a gear motor 68 (FIG. 5) which rotates the shaft 62 and the pulley 64 such that the upper passes of the belts 66 move away from the feed conveyor 20 and toward the pocket conveyor 24.

In addition, the spreading conveyor 22 has a pair of side frames 70 located beyond the ends of the side frames 44 for the feed conveyor 20 (FIGS. 5 & 6). Each side frame 70 holds three vertical shafts—namely a rear shaft 72 which rises through the frame 70 directly above the cross shaft 32, a front shaft 74 which rises through the frame 70 directly above the cross shaft 62, and an intermediate shaft 76 which is located between the rear and front shafts 72 and 74. Each of the vertical shafts 72, 74 and 76 contains circumferential grooves which open outwardly and receive side belts 80 which pass over the shafts 72, 74 and 76. Each front shaft 74 is coupled to a separate synchronous gear motor 82 (FIG. 6) which is stabilized by the side frame 70 through which its shaft 74 rises. The motors 82 turn the shafts 74 such that the inner passes of the side belts 80 move away from the feed conveyor 20 and toward the pocket conveyor 24. In other words, the inner passes of the side belts 80 move in the same direction as the upper passes of the table belts 66—and at the same velocity as well.

Within each side frame 70 the front shaft 74 and the intermediate shaft 76 are the same diameter and are in alignment, the latter being directly behind the former (FIG. 5). Thus, the inner passes of the side belts 80 lie parallel to the centerline C of the conveyor 22 in the regions thereof that are between the intermediate shaft 76 and the front shaft 74. As a consequence, these regions of the side belts 80 on the two side frames 70 lie parallel to each other. The spacing between these parallel regions should equal the spacing between the inner passes of the side belts 36 for the feed conveyor 20, so the signatures S in the downstream region of the spreading conveyor 22 will bow forwardly to essentially the same degree as in the feed conveyor 20. However, upstream from the intermediate shafts 76, the side belts 80 of the spreading conveyor 22 lie slightly oblique to the centerline C of the conveyor 22, and indeed, the side belts 80 of the two side frames 70 converge in this region, this deriving from the fact that the rear shafts 72 are of lesser diameter than the front and intermediate shafts 74 and 76 and are offset outwardly from the shafts 74 and 76. These oblique regions of convergence are located at the gates 50, and indeed, the gates 50 when fully open lie along and generally parallel to the converging regions for the inner passes of the side belts 80.

The two side frames 70, while being mounted on the frame 14 of the machine A, are adjustable inwardly and outwardly so that the machine A will accommodate signatures S of varying width.

Figure 7:
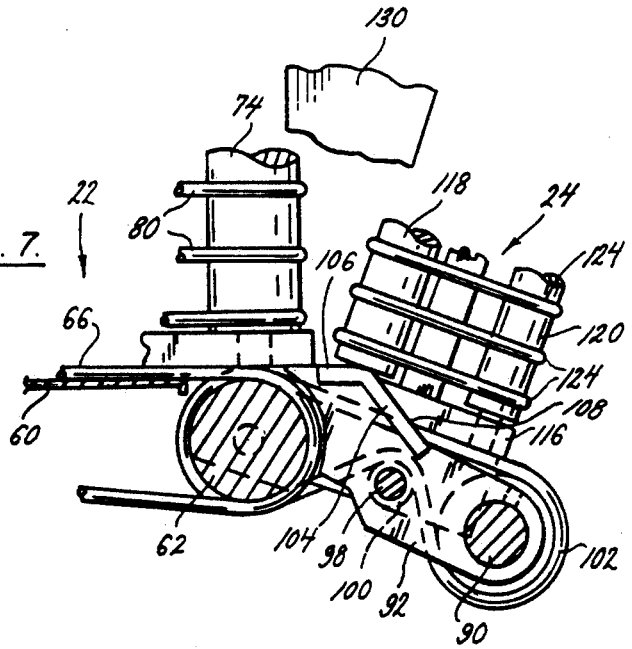
FIG. 7 is a sectional view taken along line 7—7 of FIG. 5 and showing a support block for preventing the signatures from toppling out of the spreading conveyor.

Whereas the spreading conveyor 22 leads up to the pocket 4 for the delivery unit 2 of the binding machine B, the pocket conveyor 24 is actually in the pocket 4, it being inclined about 20° to match the inclination of the back wall 8 of the pocket 4 (FIG. 6). The pocket conveyor 24 shares the cross shaft 62 with the spreading conveyor 22 and in addition has another cross shaft 90 located deep within the pocket 4. The shaft 90 is actually segmented so gaps exist within it (FIG. 5) and the individual segments are supported on arms 92 (FIG. 7) which project forwardly from the frame 14 of the machine A. The shaft 90 carries pulleys 94 which are offset laterally from the table belts 66 of the spreading conveyor 22. The cross shaft 62, which is common to the two conveyors 22 and 24, on the other hand, contains more circumferential grooves which align with the pulleys 94. Finally, the arms 92 carry still another cross shaft 98 which lies between shafts 62 and 90 and carries pulleys 100 which are smaller in diameter than both the cross shaft 62 and the pulleys 94 on the shaft 90. The intermediate cross shaft 98 is adjustable upwardly and downwardly. Extended over the pulleys 94 on the shaft 90 as well as around the shaft 62 at the grooves in it are more table belts 102 (FIGS. 5–7) which along their lower passes loop upwardly over the pulleys 100 on the intermediate cross shaft 98.

The upper passes of the table belts 102 are inclined at about 20° to match the inclination of the pocket 4 and indeed serve as the floor of the pocket 4. In effect, the upper passes of the table belts 102 for the pocket conveyor 24 lie at an angle in excess of 180° with respect to the upper passes of the table belts 66 for the spreading conveyor 22. Along the cross shaft 62, which the two conveyors 22 and 24 share, the table belts 102 of the pocket conveyor 24 are interposed between the table belts 66 of the spreading conveyor 22 (FIG. 5).

Even so, the shaft 62 along the centerline C of the conveyors 22 and 24 remains free of both types of belts 66 and 102. Here the pocket conveyor 24 is fitted with a support block 104 (FIGS. 5 & 7) having a horizontal upper surface 106 and a steeply inclined surface 108 arranged in that order beyond the spreading conveyor 22. The horizontal surface 106 lies slightly below the upper surfaces of the table belts 66 on the spreading conveyor 22 and extends beyond the belts 66 and 80 of the spreading conveyor 22 a distance approximating the deflection in the signatures S resulting from the bow caused by the side belts 80. Thus, as the side margins of the signatures S approach the ends of the side belts 80 in the spreading conveyor 22, the signatures S remain supported at their bowed centers, even though the bowed centers are projected beyond the table belts 66 from which they formerly derived support. This prevents the signatures S from toppling out of the downstream end of the spreading conveyor 22 while their side margins are still along the side belts 80 of the spreading conveyor 22. The inclined surface 108 slopes downwardly at an angle greater than the 20° angle for the upper passes of the table belts 102 and indeed goes below the plane of those passes in the region of the intermediate cross shaft 98. The bowed centers of the signatures S after passing off the horizontal portions of the support block 104—which only occurs after the side margins pass beyond the side belts 80—slide down the inclined surface 108 and then onto the centermost table belts 102.

The table belts 102 of the pocket conveyor 24 are arranged in four sets (FIG. 5). The support block 104 lies between the two centermost sets of belts 102. Between these sets and the two outermost sets of table belts 102 lie carrier blocks 110, the upper surfaces of which are generally flush with or perhaps slightly below the upper surfaces of the table belts 102. The carrier blocks 110 lie in the gaps between the segments of the cross shaft 90, and there they are fitted with retard needles 112 which thread into them from beneath and protrude from their upper surfaces.

The needles 112 are inclined forwardly and have pointed ends which project beyond the upper surfaces of the blocks 110 at the downstream ends of the upper passes for the table belts 102, pointing generally toward the back wall 8 of the pocket 4. As such, the pointed ends of the needles 112 form slight restrictions or impediments to the advancement of the signatures S toward the back wall 8. They allow one signature S at a time to approach the back wall 8, maintaining enough separation between that signature S and the signature S immediately behind it to prevent the extracting mechanism 6 of the inserter unit 2 from withdrawing two signatures S instead of one from the pocket conveyor 24.

The pocket conveyor 24 also includes a pair of side frames 116 which are mounted on the side frames 70 of the spreading conveyor 22 and thus move laterally with the side frames 70 (FIGS. 5 & 6). Each side frame 116 has a rear shaft 118 and a front shaft 120, both of which rise through it parallel to the back wall 8 of the pocket 4. The front shaft 120 is set back somewhat from the back wall 8 and is further of a lesser diameter than the rear shaft 118. Thus, the two shafts 118 and 120, while being parallel to each other, are inclined at about 20° with respect to the vertical shafts 72, 74 and 76 in the side frames 70 of the spreading conveyor 22. The shafts 118 and 120 contain circumferential grooves, and at their grooves hold side belts 124 which pass around the shafts 118 and 120. The inner passes of the side belts 124 on the two side frames 116 diverge slightly between the shafts 118 and 120 and hence are oblique to the centerline C of the conveyors 22 and 24. They also align with the inner passes of the side belts 80 at the downstream end of the spreading conveyor 22, where they are spaced essentially the same distance apart. Hence, the signatures S remain bowed upon entering the pocket conveyor 24.

The rear shaft 118 within each side frame 116 of the pocket conveyor 24 is coupled to a synchronous gear motor 126 which drives the side belts 124 such that their inner passes move downstream away from the spreading conveyor 22. That is the direction in which upper passes of the table belts 102 move, and while the motors 126 drive the belts 124 at essentially the same velocity as the table belts 102, the motors 126 are controlled independently of each other and independently of the motor 68 which drives the table belts 66 and 102 and also independently of the motors 82 which drive the preceding side belts 80. This independent control enables the pocket conveyor 24 to bring the signatures S up to the back wall 8 of the pocket 4 with considerable precision, that is to say with the proper transverse and upright orientations. Moreover, the divergence of the inner passes for the side belts 124 is such that the side edges of the signatures remain in contact with the side belts 124 all the way to the front shafts 120, but the bow in the signatures S gradually diminishes and is virtually eliminated by the time the signatures S reach the front shafts 120. Thus, the signatures S approach the back wall 8 without any skew and generally flat and as a consequence are in the proper position for withdrawal by the extracting mechanism 6 of the inserter unit 2.

The rear shafts 118 for the pocket conveyor 24 and the front shafts 74 for the spreading conveyor both rise through their respective side frames 116 and 70 from the region of the cross shaft 62 which the two conveyors 22 and 24 share, and here the shafts 118 and 74 are quite close to each other as are the side belts 124 and 80 which pass around them (FIG. 6). But by reason of the inclination of the pocket conveyor 24, the rear shafts 118 of that conveyor diverge from the front shafts 74 of the spreading conveyor 22, creating voids between the two conveyors 22 and 24. These voids are occupied by deflecting plates 130, the inwardly presented surfaces of which lie generally flush with the inner passes of the side belts 80 at the downstream end of the spreading conveyor 22 and the inner passes of the side belts 124 for the pocket conveyor 24 (FIG. 5). By reason of the set back for the front shafts 120, the side belts 124 do not extend all the way to the back wall 8 of the pocket 4—indeed gaps exist between the back wall 8 and the pocket conveyor 24, both along the sides and bottom of that conveyor.

The signatures S as they move out of the spreading conveyor 22 emerge initially at their bowed centers, but nevertheless remain supported in the plane of the table belts 66 by reason of the support block 104 which forms an extension of the base plate 60 into the pocket conveyor 24. As a consequence, the leading signatures S of an edge-standing array of signatures will not topple forwardly into the pocket conveyor 24 while its side margins are along the side belts 80 of the spreading conveyor 22. Indeed, only after the side margins of the leading signatures S pass free of the side belts 80 does that signature S change its orientation, for at that time its bowed center passes from the horizontal surface 106 of the support block 104 to the inclined surface 108, whereupon the signature S tilts forwardly in a controlled descent and change in orientation. The bowed center portion slides down the inclined surface 108 of the support block 104 and onto the centermost sets of table belts 102 in the pocket conveyor 24. The side margins, on the other hand, pass over the deflecting plates 130 which hold them inwardly and thereby maintain the bow in the signature S. As the bowed center portion moves off the inclined surface 108 of the support block 104 and onto the table belts 102 of the pocket conveyor 24, the side margins move off the deflecting plates 130 and onto the side belts 124 of the pocket conveyor 24. Thus, the leading signature S undergoes a smooth transition from the horizontal spreading conveyor 22 to the inclined pocket conveyor 24 without toppling over or otherwise going out of control, and the same holds true for all signatures S that follow. In other words, the machine A maintains control over the leading signature S and all following signatures S as they undergo the angular transition between the spreading conveyor 22 and the pocket conveyor 24.

Thereafter, the leading signature S proceeds along the pocket conveyor 24, its bow gradually diminishing and virtually being eliminated by the time the side margins of the signature S pass off the side belts 124 at the downstream end of the conveyor 24. The side belts 124 and table belts 102 of the pocket conveyor 24 control the orientation of the signature S with considerable precision and deliver it for acceptance by the extracting mechanism 6 of the inserter unit 2.

To achieve this control, the stream feeding machine A has a sensing mechanism 132 (FIGS. 4 & 6) for monitoring the orientation of the signatures S at the discharge end of the pocket conveyor 24. The sensing mechanism 132 includes a pivot rod 134 which is mounted on the inserter unit 2 near the upper end of the back wall 8 for the pocket 4. The rod 134 lies parallel to the exposed face of the back wall 8 and also parallel to the plane of the upper passes of the table belts 102. The sensing mechanism 132 also includes three sensor plates—namely a center plate 136 and two side plates 138—each of which is suspended from the pivot rod 134 such that it lies over the inclined back wall 8 of the pocket 4, yet pivots a limited amount about the axis of the rod 134. Each plate 136 or 138 projects slightly above the rod 134 and here it is connected with a tension spring which imparts a slight bias to the plate 136 or 138, urging it away from the wall 8. Behind the upwardly directed portion of each plate 136 or 138 lies an inductive proximity sensor 142 which monitors the position of the upper end of its plate 136 or 138, producing an electrical signal which reflects that position, and more importantly the position of the lower end as well. The center plate 136 lies between the two side plates 138, indeed along the center of the back wall 8 and the centerline C of the conveyor 24. The side plates 138 lie close to the inner passes of the side belts 124 for the pocket conveyor 24. The signal produced by the proximity sensor 142 for the center plate 136 controls the motor 68 which drives the table belts 66 of the spreading conveyor 22 and the table belts 102 of the pocket conveyor 24. It also controls the gear motors 82 which drive the side belts 80 of the spreading conveyor 22. By reason of this signal, the motors 68 and 82 operate in unison—and the belts 66, 80 and 102 move at the same velocity. The signals from the proximity sensors 142 for the side plates 138, on the other hand, control the motors 126 that drive the side belts 124 of the pocket conveyor 24—the sensor 142 for the right side plate 138 controlling the right gear motor 126 and the sensor 142 for the left side plate 138 controlling the left gear motor 126.

The circuitry is such that the synchronous motors 68, 82 and 126 are either on or off. The longer a motor is on the further the belts driven by it will advance with respect to the belts driven by the other motors.

The leading signatures S in the array that extends backwardly through the three conveyors 24, 22 and 20 in that order will exert a force against the center plate 136 and the circuitry turns the gear motor 68 which drives the table belts 66 and 102 on and off such that the force remains essentially constant. That constant force correlates with a desired upright orientation of the signatures S at the end of the pocket conveyor 24. The leading signature S will also exert a force on the left and right side plates 138, and the circuitry, utilizing signals from the proximity sensors 142 behind those plates, turns the gear motors 126 off and on such that the sides of the signatures S in the pocket conveyor 24 remain generally aligned with the center portions of those signatures S, that is to say the signatures S within the pocket conveyor 24 remain truly transverse with respect to the direction of advance and are not skewed. Should the sensor 142 behind the left sensor plate 138 detect a lag in the left sides of the signatures S, it will cause the left gear motor 126 to operate longer than the right gear motor 126 to bring the left sides of the signatures S even with the right sides—and of course vice versa. In any event, the orientation of the signatures S in the pocket conveyor 24 is such that when a signature S reaches the end of that conveyor, that is when it is against the center and side plates 136 and 138, it is in the correct upright and transverse orientation for withdrawal by the extracting mechanism 6.

In operation, a workman places a handlift or short stack of signatures S on the feed end of the feed conveyor 20 and slides it forwardly between the extended side belts 36 of that conveyor and into the trough-like space between the full complement of side belts 36. Inasmuch as the spacing between the side belts 36 on each side of the conveyor 20 is less than the width of the signatures S, the signatures S assume a bowed configuration on the conveyor 20. The workman insures that the bow is presented forwardly toward the spreading conveyor 24. The workman may jog or tamp the signatures to insure that their folds come to rest on the table belts 26 of the feed conveyor 20. The table and side belts 26 and 36 advance the signatures S in the upstanding bowed condition, and as they advance the leading signatures S remain upright inasmuch as their side edges are against and confined by the side belts 36. More hand lifts or short stacks of signatures S are loaded onto the feed conveyor 20 in a like manner. Any remaining space between hand lifts is consolidated in the process of going through the gates 50 as the belts 26 and 36 urge the lifts forwardly against the spring bias of the gates 50. The result is an extended array of signatures S along the feed conveyor 20.

Eventually the leading signature S in the array reaches the gates 50 at the end of the feed conveyor 20, which gates lie in the path of signatures S owing to the spring bias on them. The belts 26 and 36 of the feed conveyor 20 drive the leading signatures S into the gates 50, which spreads the gates 50 apart, and causes the signatures S in the region of the gates 50 to acquire a more pronounced bow. With continued advancement of the signatures S, the side edges of the leading signatures S and those behind it slide over the gates 50, which are now spread somewhat against the spring bias. The potentiometers 54, which the gates 50 operate, produce signals, which are really not significant at the time, but become so when the system stabilizes.

In time the leading signatures S emerge from the gate 50, whereupon their sides spring beyond the gates 50 and against the side belts 80 of the spreading conveyor 22. By this time the bowed center portions of the leading signatures S have already passed from the table belts 26 of the feed conveyor 20 to the table belts 66 of the spreading conveyor 22. Since the table belts 66 and side belts 80 of the spreading conveyor 22 operate at a greater velocity than the table and side belts 26 and 36 of the feed conveyor 20, the signatures S within the spreading conveyor 22 are not consolidated as tightly as they are within the feed conveyor 20. Nevertheless, the signatures S within the spreading conveyor 22 do produce a back pressure so-to-speak which causes the gates 50 to assume positions somewhat displaced from their fully open positions. Indeed, the signals derived from the potentiometers 54 attached to the gates 50 reflect the positions of the gates 50. The circuitry derives an average from the signals and operates the gear motors 34 and 48 for the table and side belts 26 and 36—turning them on and off so as to maintain the average substantially constant. As a consequence, the signatures S pass to the end of the spreading conveyor in a uniform and desired state of consolidation.

As the side margins of the leading signature S approach the end of spreading conveyor 22, the bowed center portion of that signature S rides out onto the horizontal surface 106 of the support block 104, and thus the leading signature S remains perfectly upright, even though no signature S lies ahead of it to prevent it from toppling forwardly. When the side margins of that signature S reach the ends of the side belts 80, the bowed center portion reaches the inclined surface 108 of the block 104. The leading signature S at this time descends forwardly, its bowed center portion being under control of the inclined surface 108, while its side margins, now free of the side belts 80, pass over and are controlled by the deflecting plates 130 and the table belts 102 that carry the side margins of signatures S on the pocket conveyor 24. Quickly, the lower margin of the leading signature S moves onto the table belts 102 of the pocket conveyor 24 at the bowed center portion and elsewhere as well, while the side margins move into the space between the side belts 124 of the pocket conveyor 24. The trailing signatures S follow. Now the table and side belts 102 and 124 advance the signatures S through the pocket 4 of the inserter unit 2 toward the back wall 8. Initially, the leading signatures S are bowed on the pocket conveyor 24, but owing to the divergence of the inner passes for the side belts 124, the bow diminishes as the signatures S advance and is virtually eliminated where the side belts 124 pass around the front shafts 120.

Immediately before the back wall 8, the side margins of the leading signature S pass off the side belts 124 of the pocket conveyor 24, and the signature S assumes a generally planar condition along the back wall 8. At this time, the lower margin or fold in the leading signature S contacts the retard needles 112 which hold that signature S in the plane of the back wall 8. The retard needles 112 prevent the extracting mechanism 6 from withdrawing more than one signature S at a time. Indeed, the leading signature S comes against the center plate 136 and the two side plates 138 of the sensing mechanism 132, depressing those plates against the bias of their springs 140. The plates 136 and 138 pivot about the axis of the pivot rod 134 and the position assumed by each is reflected in a signal derived from its proximity sensor 142. The proximity sensor 142 for the center plate 136 controls the motor 68 which drives the table belts 66 and side belts 80 of the spreading conveyor 22 and also the table belts 102 of the pocket conveyor 24. Through this means of control the leading signature S and those which follow are oriented at essentially the same angle as the back wall 8. The proximity sensors 142 for the side plates 138 control the motors 126 for the side belts 124 of the pocket conveyor 24 and operate those belts 124 such that the side margins of the signatures S within the pocket conveyor 24 are generally even across the conveyor and hence approach the ends of and move off the side belts 124 uniformly. By reason of this control, each signature S, before it is withdrawn by the extracting mechanism 6 lies generally flat against the plates 136 and 138, generally parallel to the back wall 8 of the pocket 4 and with the fold in contact with retarding needles 112—a position which is best suited for withdrawal by the extracting mechanism 6.

In lieu of the support block 104 for maintaining the signatures S upright as they emerge from the spreading conveyor 22, the pocket conveyor 24 may be provided with a support belt 146 (FIGS. 8 & 9) for this purpose, and like the support block 104, the support belt 146 lies along the centerline C of the conveyors 22 and 24. Whereas the upper passes for table belts 102 of the pocket conveyor 24 lie at an angle to the table belts 66 of the spreading conveyor 22 and in essense form the floor of the pocket 4, the support belt 146 in its upper pass has a horizontal run 148 and an inclined run 150. The horizontal run 148 lies in the same plane as the upper passes of the table belts 66 for the spreading conveyor 22 and indeed forms an extension of those passes into the pocket conveyor 24, but only at the center of the pocket conveyor 24. The inclined run 150, on the other hand, drops downwardly at an angle greater than the inclination of the upper passes for table belts 102 for the pocket conveyor 24 and passes beneath those upper passes intermediate their ends—indeed well before the terminal ends.

To this end the pocket conveyor 24 has an upper pulley 152 (FIGS. 9) located above the pulleys 94 on the endmost cross shaft 90 and also another pulley 154 located between the endmost cross shaft 90 and the intermediate cross shaft 98. The belt 146 loops around the cross shaft 62 between the spreading and pocket conveyors 22 and 24 at one end and at its opposite end loop around the pulley 154. The upper pulley 152 forms the transition between the horizontal run 148 and inclined run 150 in the upper pass, whereas the lower pass comes over the intermediate cross shaft 98. The support belt 146, being around the cross shaft 62, operates at the same velocity as the table belts 66 in the spreading conveyor 22 and the table belts 102 in the pocket conveyor 24.

When a signature S emerges from the spreading conveyor 22, its bowed center portion remains on the support belt 146 until the side margins of the signature S reach the ends of the side belts 80. The signature S does not topple forwardly, but instead remains upright—at least until the center of the signature S reaches the end of the horizontal run 148 for the belt 146. At this time, the bowed center portion moves down the inclined run 150 of the belt 146, while the side margins are contained by the deflecting plates 130 and are conveyed downwardly by the table belts 102. The bowed center portion then moves onto the centermost table belts 102 while the side margins move between and bear against the side belts 124 and the outermost table belts 102 of the pocket conveyer 24.

This invention is intended to cover all changes and modifications of the example of the invention herein chosen for purposes of the disclosure which do not constitute departures from the spirit and scope of the invention.

What is claimed is:

1. A machine for holding flexible sheets and delivering the sheets to a specific location, said machine comprising: a first conveyor having a bottom surface for supporting the sheets in an edge standing condition and side belts on each side of the bottom surface, with the spacing between side belts being less than the width of the sheets so that the side edges of the sheets will contact the side belts and the sheets will acquire a bow, the first conveyor further having first drive means for moving the side belts to advance the sheets in the first conveyor; and a second conveyor aligned with the first conveyor at the downstream end of the first conveyor and having a bottom surface located in excess of 180° with respect to the bottom surface of the first conveyor for supporting the sheets after they leave the first conveyor, the second conveyor also having side belts which are spaced close enough together to contact the side edges of the sheets and maintain the bow in the sheets after they leave the first conveyor, the second conveyor further having means for moving the side belts of the second conveyor to advance the sheets away from the first conveyor, the means for moving the side belts having the capacity to control the side belts of the second conveyor independently of each other so that the orientation of the sheets within the second conveyor may be controlled.

2. The machine according to claim 1 and further comprising side sensors at the discharge end of the second conveyor in a location where they detect the sides of the sheets, the side sensors being coupled with second drive means to control the side belts and thus the orientation of the sheets in the second conveyor.

3. A machine according to claim 2 wherein the bottom surface of the second conveyor comprises table belts which move with the side belts of the second conveyor, and the second conveyor further has means for driving the table belts.

4. A machine according to claim 3 and further comprising a center sensor at the discharge end of the second conveyor in a location where it monitors the position of the midportions of the sheets, the center sensor being coupled to the drive means for the table belts to control the upright orientation of the sheets at the discharge end of the second conveyor.

5. A machine according to claim 4 wherein the bottom surface of the first conveyor comprises table belts.

6. A machine according to claim 5 wherein the drive means for the table belts of the second conveyor also drives the table belts of the first conveyor.

7. A machine according to claim 2 wherein the side belts of the second conveyor are spaced from the side belts of the first conveyor, and further comprising deflecting surfaces located between the side belts of the first and second conveyor where they are positioned to hold the side edges of the bowed sheets inwardly as the sheets pass from the first conveyor to the second conveyor and thus maintain the sheets in a bowed condition during the transition.

8. A machine according to claim 1 and further comprising support means located midway between the side belts of the second conveyor and extended from the discharge end of the first conveyor for supporting the bowed center regions of the sheets emerging from the first conveyor generally while the side edges of those sheets are still in contact with side belts of the first conveyor, so the sheets do not topple out of the first conveyor while still along the side belts of the first conveyor.

9. A machine according to claim 1 and further comprising a third conveyor located upstream from the first conveyor and being aligned with the first conveyor, the third conveyor having side belts which are spaced apart a distance less than the width of the sheets so that the sheets may bow forwardly on the third conveyor.

10. A machine according to claim 9 wherein the side belts of the third conveyor generally operate at a lesser velocity than the side belts of the first conveyor so that the sheets are less consolidated on the first conveyor, and further comprising means for controlling the third conveyor, so that it supplies the first conveyor with sheets sufficient to maintain a desired consolidation on the first conveyor.

11. A machine according to claim 1 wherein the side belts of the pocket conveyor diverge downstream and at their downstream ends are spaced apart a distance approximating the width of the sheets.

12. A machine for holding flexible sheets and for delivering the sheets to a specific location, said machine comprising: a first conveyor having a feed end and a discharge end and side belts extending generally between the ends as well as a bottom surface located between and generally parallel to the side belts, the spacing between the side belts being less than the width of the sheets, the first conveyor being capable of holding the sheets in an upstanding condition with their bottom margins against the bottom surface and their side margins against the side belts and with the sheets bowed forwardly toward the discharge end of the conveyor; a second conveyor aligned with the first conveyor and having a feed end at the discharge end of the first conveyor and a discharge end located at the specific location to which the sheets are to be delivered, the second conveyor likewise having side belts which are spaced apart a distance less than the width of the sheets so that the sheets upon passing from the first conveyor to the second conveyor will remain bowed forwardly, the second conveyor also having a bottom surface which is located between and generally parallel to the side belts of the second conveyor, the bottom surface of the second conveyor being inclined relative to the bottom surface of the first conveyor at an angle exceeding 180°; drive means for moving the side belts of the first and second conveyors to advance the sheets in those conveyors toward the discharge ends of the conveyor; and support means for supporting the sheets in the region of their bowed centers above the bottom surface of the second conveyor generally while the side margins of the sheets are against the side belts of the first conveyor.

13. A machine according to claim 12 wherein the support means provide a surface which forms an extension of the bottom surface of the first conveyor.

14. A machine according to claim 13 wherein the surface of the support means moves in the direction that the side belts advance the sheets.

15. A machine according to claim 13 wherein the bottom surfaces of the first and second conveyors are table belts which move in the direction that the side belts advance the sheets and likewise serve to advance the sheets.

16. A machine according to claim 15 wherein the drive means controls the side belts of the second conveyor independently of each other so as to adjust the transverse orientation of the sheets as they emerge from the discharge end of the second conveyor.

17. A machine according to claim 16 and further comprising side sensors for monitoring the sides of the sheets as they emerge from the second conveyor and for controlling the drive means such that the side belts of the second conveyor operate to maintain a desired transverse orientation.

18. A machine according to claim 17 and further comprising a center sensor for monitoring the upright orientation of the sheets and for controlling the drive means such that the table belts operate to impart the desired upright orientation.

19. In combination with an inserter unit having a pocket which ends at a back wall that is inclined somewhat with respect to the vertical and a mechanism for extracting signatures one at a time from the pocket at the back wall, a machine for holding signatures in an edge-standing condition and for delivering the signatures to the pocket of the inserter unit, said machine comprising: a pocket conveyor located generally within the pocket of the inserter unit and having table belts and side belts, the spacing between the side belts being generally less than the width of the signatures so that the pocket conveyor will hold the signatures in an upstanding forwardly bowed condition with their side margins against the side belts and their bottom margins on the table belts, the pocket conveyor having drive means for driving the two side belts and the table belts to advance the signatures to the back wall, the drive means controlling the side belts on each side of the table belts and the table belts independently of each other, so that the transverse and upright orientation of the signatures in the pocket conveyor may be adjusted; and a spreading conveyor aligned with and opening into the pocket conveyor, the spreading conveyor having table belts and side belts, with the spacing between the side belts being less than the width of the signatures so that the spreading conveyor will also hold the signatures in an upstanding forwardly bowed condition, with their side margins against the side belts and their bottom margins against the table belts, the table belts of the spreading conveyor in the regions where they contact the signatures being located at an angle with respect to the table belts of the pocket conveyor in the regions where those belts contact the signatures, with the angle between those regions of the two sets of belts that contact the signatures being in excess of 180°, the spreading conveyor having drive means for driving the side belts of the spreading conveyor such that they move the signatures on the spreading conveyor toward the pocket conveyor.

20. The combination according to claim 19 and further comprising a feed conveyor having table and side belts with the spacing between the side belts being less than the width of the signatures so that the feed conveyor will also hold the signatures in an upstanding forwardly bowed condition with the side margins of the signatures against the side belts and the lower margins against the table belts, the feed conveyor having drive means for driving its table and side belts such that they advance the signatures toward the spreading conveyor.

21. The combination according to claim 19 and further comprising sensors located along the back wall of the pocket for monitoring the orientation of the signatures as they approach the back wall and for controlling the drive means of the pocket conveyor so that the signatures in that conveyor approach the back plate in the desired orientation.

22. The combination according to claim 19 wherein the table belts of the pocket conveyor are inclined downwardly away from the table belts of the spreading conveyor, and further comprising support means for supporting the bowed center portions of the signatures emerging from the spreading conveyor within the pocket conveyor until generally the side edges of signatures move off the side belts of the spreading conveyor, so that the signatures do not topple out of control out of the spreading conveyor.

23. The combination according to claim 22 and further including deflecting plates between the side belts of the pocket and spreading conveyors for holding the sides of the signatures inwardly and maintaining the signatures in a bowed condition as they move from the spreading conveyor to the pocket conveyor.

24. The combination according to claim 20 wherein the drive means of the spreading conveyor advances the signatures through the spreading conveyor faster than the drive means for the feed conveyor advance the signatures through the feed conveyor, so that the signatures are less consolidated in the spreading conveyor; and further comprising gates between the feed and spreading conveyors for monitoring the force with which the feed conveyor delivers signatures to the spreading conveyor and for controlling the drive means of the feed conveyor, so that it advances the signatures through the spreading conveyor to maintain a desired force on the gates.

* * * * *